US008955583B2

(12) United States Patent
Raynal et al.

(10) Patent No.: US 8,955,583 B2
(45) Date of Patent: Feb. 17, 2015

(54) SUBSEA MULTIPLE ANNULUS SENSOR

(75) Inventors: Jeffrey A. Raynal, Houston, TX (US); Daniel C. Benson, Houston, TX (US); David L. Ford, Houston, TX (US); Aaron J. Andersen Shaw, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 333 days.

(21) Appl. No.: 13/429,814

(22) Filed: Mar. 26, 2012

(65) Prior Publication Data

US 2013/0248171 A1 Sep. 26, 2013

(51) Int. Cl.
*E21B 47/01* (2012.01)

(52) U.S. Cl.
USPC ..... 166/75.11; 166/250.01

(58) Field of Classification Search
CPC ..... E21B 33/03; E21B 33/035
USPC ..... 166/75.11, 250.01
See application file for complete search history.

(56) References Cited

U.S. PATENT DOCUMENTS

| | | | | |
|---|---|---|---|---|
| 3,974,690 | A | 8/1976 | Brock, Jr. et al. | |
| 5,366,017 | A | 11/1994 | Voss, Jr. | |
| 5,492,017 | A | 2/1996 | Jennings et al. | |
| 6,360,822 | B1 | 3/2002 | Robertson | |
| 7,073,591 | B2 | 7/2006 | Massie et al. | |
| 2001/0027865 | A1 | 10/2001 | Wester et al. | |
| 2003/0047317 | A1* | 3/2003 | Powers | 166/373 |
| 2007/0039738 | A1* | 2/2007 | Fenton et al. | 166/368 |
| 2011/0139443 | A1* | 6/2011 | Chen | 166/250.01 |
| 2011/0277456 | A1* | 11/2011 | Kidd et al. | 60/327 |
| 2013/0180726 | A1* | 7/2013 | Ross et al. | 166/336 |

FOREIGN PATENT DOCUMENTS

| | | | |
|---|---|---|---|
| GB | 2398309 | A | 8/2004 |
| WO | 2007093793 | A1 | 8/2007 |

OTHER PUBLICATIONS

GB Search Report dated Jul. 30, 2013 from corresponding Application No. GB1305367.3.

* cited by examiner

*Primary Examiner* — Brad Harcourt
(74) *Attorney, Agent, or Firm* — Bracewell & Giuliana LLP

(57) ABSTRACT

A wellbore assembly includes a housing member, an outer wellbore member, and a second wellbore member, with an outer sensor located in the annulus between the outer wellbore member and the second wellbore member. The outer sensor can sense a condition of the annulus, such as pressure or temperature, and transmit data through a solid portion of the sidewall of the outer wellbore member to a signal receiver located on the housing member. In one embodiment, the signal receiver can transmit an electromagnetic field to inductively charge a power supply on the outer sensor.

20 Claims, 4 Drawing Sheets

SUBSEA MULTIPLE ANNULUS SENSOR

BACKGROUND OF THE INVENTION

1. Field of the Invention

The present invention relates in general to a sensor assembly for a wellbore assembly, and in particular to sensors for monitoring conditions in one or more annulus spaces.

2. Brief Description of Related Art

Wellhead housings can be located on a wellbore and used to support other wellbore components used in the wellbore. Casing hangers can be landed in the wellhead housing to support tubing that is located in the wellbore. An annulus can exist between various wellbore components, such as between wellhead housings and casing hangers, between various casing hangers, or between a riser and tubing located within the riser. It is desirable for the operator to be aware of conditions within the annulus such as the presence of fluid, specific types of fluid, pressure, temperature, or pH. Sensors used to monitor such conditions can undermine the integrity of wellbore components by, for example, requiring an aperture or window that can leak. It is desirable to monitor annulus conditions without undermining the integrity of the wellbore components.

SUMMARY OF THE INVENTION

In an embodiment of the present invention, a wellbore assembly has an outer wellhead housing with a sidewall and an aperture extending through the sidewall, an inner wellhead housing concentrically located within the outer wellhead housing to define a first annulus therebetween, a first wellbore member concentrically located within the inner wellhead housing to define a second annulus therebetween, a signal receiver secured in the aperture such that at least a portion of the signal receiver is located in the first annulus, and an outer sensor assembly located in the second annulus and axially aligned with the signal receiver, the outer sensor assembly being capable of sensing a second annulus condition and transmitting data representing the second annulus condition through a sidewall of the inner wellhead housing to the signal receiver. The annulus conditions can include pressure or temperature.

One embodiment can also include a second wellbore member, the second wellbore member being concentrically located within the first wellbore member to define a third annulus therebetween, and an inner sensor assembly located in the third annulus and being capable of sensing a third annulus condition and transmitting data representing the third annulus condition through a sidewall of the first wellbore member to the signal receiver.

In another embodiment, the outer sensor assembly is located on an outer diameter of a sidewall of the first wellbore member, and the first wellbore member has a centralizer protruding from the outer diameter of the sidewall of the first wellbore member, the centralizer protruding into the second annulus a greater distance than the outer sensor assembly. In an embodiment, the signal receiver has a corrosion resistant outer housing and the outer housing is able to withstand exposure to concrete. The outer sensor assembly can include a sensor, a transmitter, and a power supply.

In one embodiment, the signal receiver includes an electromagnetic field generator, the power supply includes a battery and a charger, and the charger can inductively charge the battery in response to the electromagnetic field. In one embodiment, the outer sensor assembly includes a memory and stores the data representing the second annulus condition at least until the data representing the second annulus condition is transmitted to the signal receiver. In one embodiment, the signal receiver transmits the data to a computer.

In one embodiment, the wellbore assembly includes a current generator in contact with seawater outside of the housing member and connected to the signal receiver, the current generator producing electric current in response to movement of the seawater and transmitting the electric current to the signal receiver. In one embodiment, the current generator can include a turbine, the turbine rotating in response to movement of the seawater.

In one embodiment, the outer sensor assembly is one of a plurality of sensor assemblies spaced apart around the outer diameter of the first wellbore member, each sensor assembly having a transmitter, wherein the transmitter of the sensor assembly nearest the signal receiver can transmit data from one or more of the plurality of sensor assemblies.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
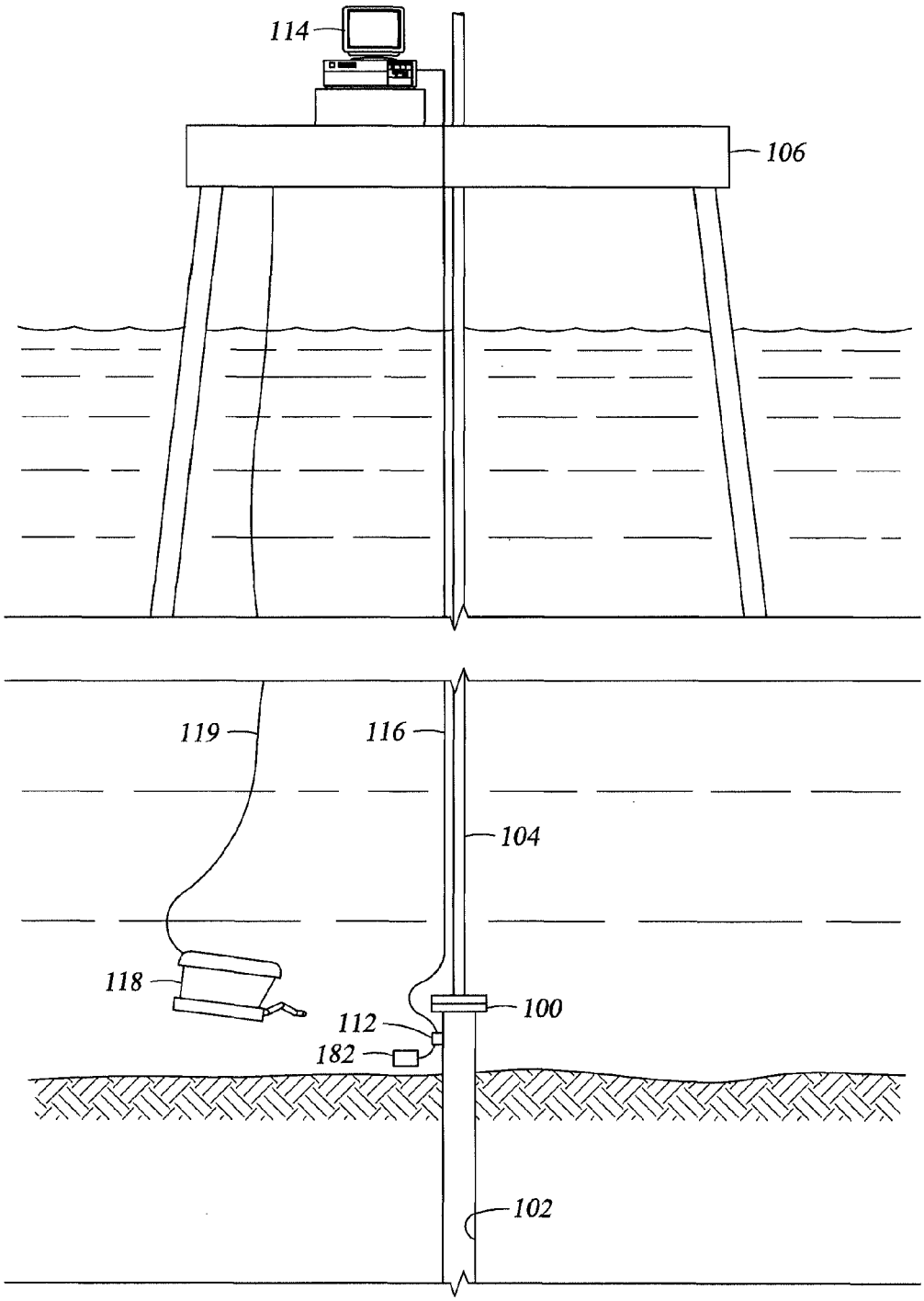
FIG. 1 is a side view of a subsea well having an embodiment of the wellbore annulus monitoring system.

Referring to FIG. 1, wellhead housing 100 is an outer wellhead housing connected to wellbore 102. Riser 104 extends from wellhead housing 100 to drilling platform 106. Sensor assemblies 108 and 110 (FIG. 2) can be located within wellhead housing 100. As will be described in more detail, signal receiver 112 can receive data from outer sensor assembly 108 and inner sensor assembly 110, and relay that data to computer 114. Sensor assemblies 108 and 110 can be the same type of sensor assembly or can be different. For purposes of this description, sensor assembly 110 shall refer to a sensor assembly that can be used in either location, unless specified otherwise.

Computer 114 can be located apart from signal receiver 112 such as, for example, on drilling platform 106. In one embodiment, cable 116 can be used to provide power to signal receiver 112 and to transmit data from signal receiver 112 to computer 114. As will be described in more detail, signal receiver 112 can alternatively be powered by other sources. A remotely operated vehicle ("ROV") 118 can be used to install or service components associated with wellhead housing 100, including, for example, signal receiver 112. ROV 118 can be connected to platform 106 by, for example, umbilical 119. Umbilical 119 can extend along riser 104 to platform 106. Other types of controls can be used. In one embodiment, a housing member, such as wellhead housing 100, is part of a wellbore assembly connected to wellbore 102. The embodiment shown is a subsea wellhead housing 100, but could be any type of housing associated with a wellbore.

Figure 2:
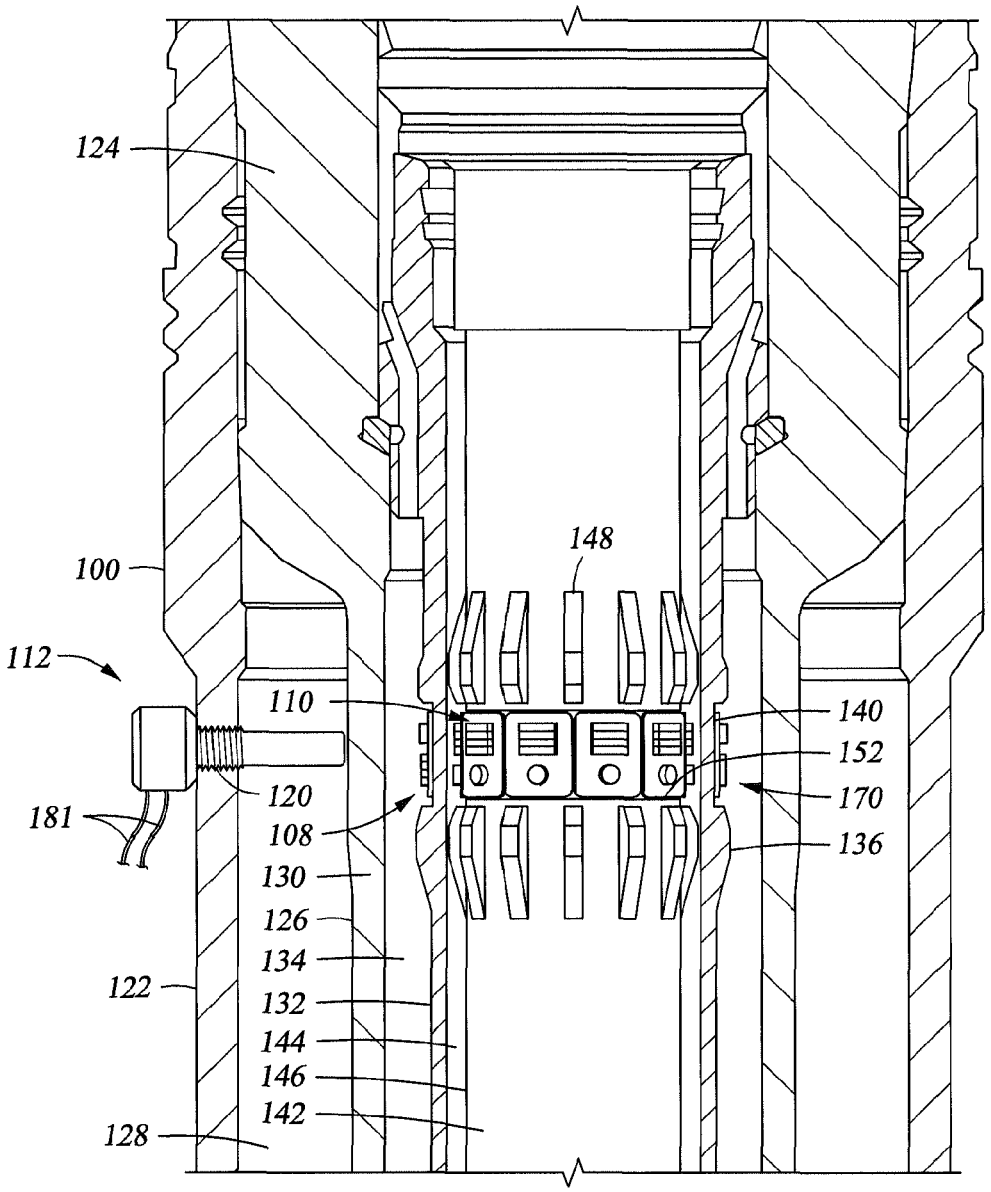
FIG. 2 is an enlarged partial sectional view of the wellbore annulus monitoring system of FIG. 1.

Referring to FIG. 2, aperture 120 is an opening through sidewall 122 of wellhead housing 100. Aperture 120 can be any shape including, for example, round. The inner diameter surface of aperture 120 can be a relatively smooth inner diameter surface, or can be a threaded inner diameter surface. A high pressure wellhead assembly, such as inner wellhead housing 124, can be concentrically located within wellhead housing 100. Inner wellhead housing 124, which can be conventional, can be a cylindrical member having a sidewall 126. In one embodiment, sidewall 126 is solid, such that there are no through-wall penetrations, such as orifices or ports, through sidewall 126. In other embodiments, there are through-wall penetrations through the portion of sidewall 126 that align with aperture 120 or no through-wall penetrations for the purpose of sensing conditions within annulus 128. Thus, no leak paths are created for the purpose of sensing annulus conditions by sensor assemblies 108, 110. An outer diameter of sidewall 126 can be less than an inner diameter of wellhead housing 100, such that an annulus 128 is located therebetween. As one of skill in the art will appreciate, annulus 128 can be filled with concrete during cementing operations.

A second wellbore member, such as casing hanger 130, can be concentrically located within inner wellhead housing 124. Casing hanger 130 can be an annular member having a sidewall 132. In some embodiments, casing hanger 130 can be axially supported by inner wellhead housing 124. An outer diameter of sidewall 132 can be less than in inner diameter of sidewall 126 of inner wellhead housing 124, thus defining annulus 134 therebetween.

In one embodiment, casing hanger 130 has a centralizer 136 on an outer diameter of sidewall 132. Centralizer 136 can include guides or annular bands, which can be individual protrusions outward from sidewall 132. Sensor pocket 140 is a portion of sidewall 132 having an outer diameter that is smaller than an outer diameter defined by centralizer 136. During insertion of casing hanger 130, centralizer 136 can protect sensor 108 located in sensor pocket 140 from contacting another wellbore member including, for example, inner wellhead housing 124.

In one embodiment, another wellbore member such as, for example, tubing hanger 142, can be concentrically located within, and supported by, casing hanger 130. An outer diameter of tubing hanger 142 can be less than an inner diameter of casing hanger 130, thus defining an annulus 144 therebetween. Sidewall 146 of tubing hanger 142 can include a centralizer 148 having guides to define and protect sensor pocket 152. Centralizer 148 is an array of axially extending blades spaced apart around tubing hanger 142. As with inner wellhead housing 124, casing hangers 130 and 142 can each have an absence of through-wall penetrations, such as orifices or ports, for the purpose of detecting annulus conditions.

One or more sensor assemblies 110 can be located within annulus 134 or annulus 144. In one embodiment, sensor assemblies 110 can be located on an outer diameter of casing hanger 130 or tubing hanger 142 including, for example, in sensor pockets 140 or 152. Alternatively, sensor assemblies 110 can be located elsewhere within annulus 134 or annulus 144 such as, for example, on an inner diameter of casing hanger 130. Sensor assemblies used within an annulus can be the same or different than other sensors used within the same annulus. Furthermore, sensor assemblies used in one annulus can be the same or different than sensors used in another annulus.

Figure 3:
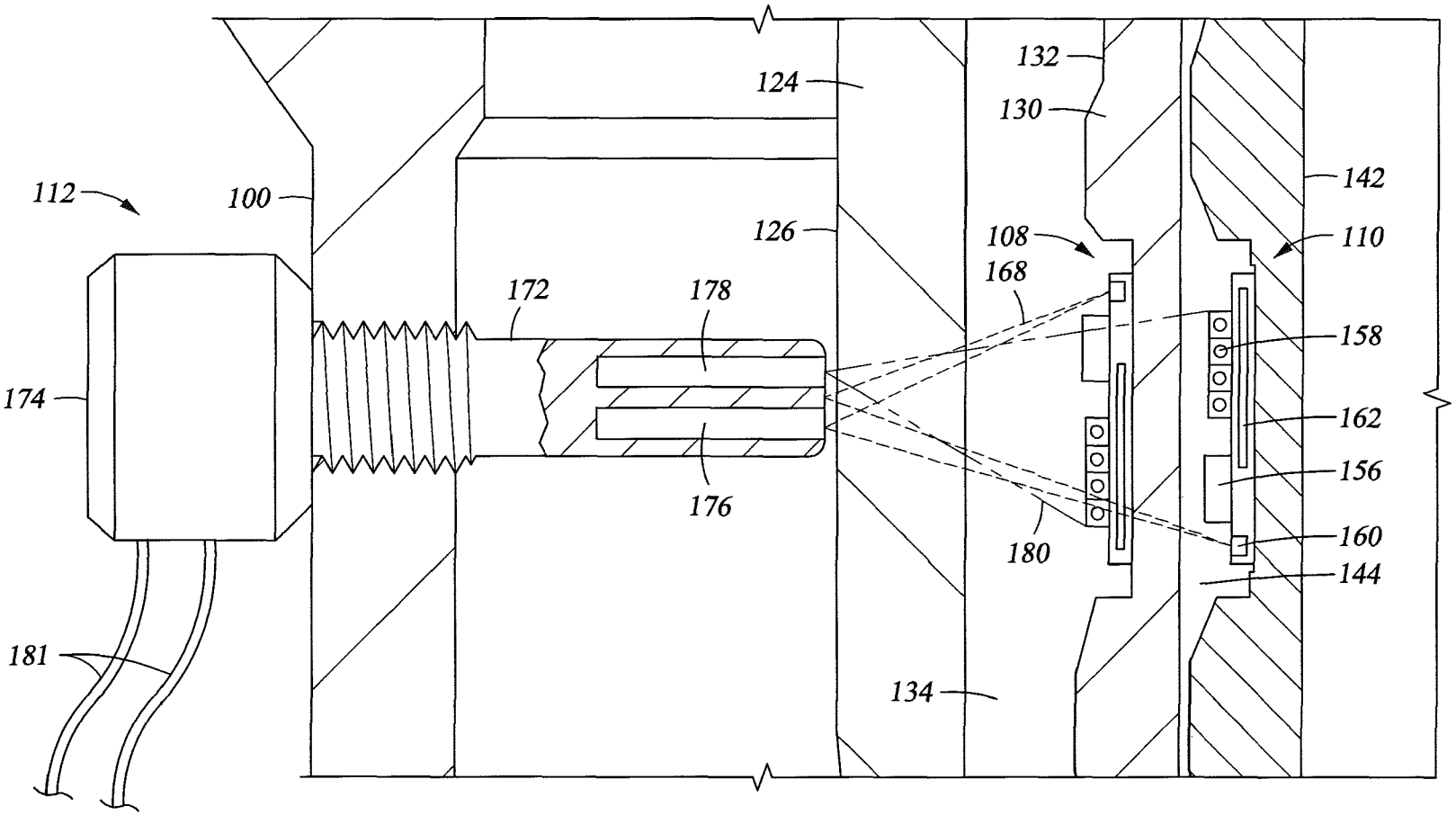
FIG. 3 is a block diagram showing components associated with the annulus monitoring system of FIG. 1.

Referring to FIG. 3, a sensor assembly 108, 110 can include, for example, a sensor element 156, a power supply 158, a transmitter 160, and a controller 162, any or all of which can be enclosed in sensor housing 164. Housing 164 can be made of any of a variety of materials including, for example, steel, or a corrosion resistant alloy ("CRA") such as an Inconel or cobalt based alloy. In one embodiment, housing 164 is not damaged by cement or corrosive fluids that may be present in annulus 134, 144. Controller 162 can include a microprocessor and a memory for storing data. The memory (not shown) can be, for example, flash memory. Sensor element 156 can be a sensor that can detect or sense various characteristics within annulus 134 or annulus 144. Those characteristics can include, but are not limited to, the presence of fluid, the identity or composition of fluid (including gas or liquids), pH, temperature, and pressure.

Power supply 158 can be a power supply that stores power for use by sensor assembly 110. Power supply 158 can include a battery or capacitor. In one embodiment, power supply 158 can include an inductive charger that can generate an electric current in response to an electromagnetic field. The generated electric current can be used to power other components of sensor assembly 110 or to charge the power storage component of power supply 158.

Transmitter 160 can be used to transmit data from sensor assembly 110 to signal receiver 112 or to another sensor assembly 110. The transmitted data can include, for example, the characteristics sensed by sensor element 156 and the condition of power supply 158. In one embodiment, transmitter 160 can receive data from other sensor assemblies 110 such as, for example, by a cable (not shown) or by radio frequency, and then re-transmit that received data. In one embodiment, sidewall 126 and sidewall 132, of inner wellhead housing 124 and casing hanger 130, are solid in the vicinity of sensor assemblies 110—meaning that there is an absence of apertures or openings through the sidewalls. Because the sidewalls 126 and 132 are solid, fluids are not able to pass through the sidewalls from annulus 144 to annulus 134, or from annulus 134 to annulus 128. Furthermore, the sensor assemblies 110 do not require apertures, sealed or otherwise, to pass electromagnetic waves, including radio frequency signals 168, to and from signal receiver 112. Thus, no leak paths are created for the purpose of sensing annulus conditions by sensor assembly 110. Rather, transmitter 160 can pass electromagnetic waves, such as data signals 168, through solid portions of inner wellhead housing 124 and casing hanger 130 to signal receiver 112.

Referring back to FIG. 2, sensor assemblies 110 can be spaced apart around a circumference within annulus 134 or 144 to form sensor ring 170. The sensor assemblies 110 can be equally spaced apart, or can be arranged with unequal spacing between adjacent sensor assemblies 110. Sensor assemblies 110 may all provide the same sensor information.

Sensor assemblies 108 may all provide the same information. By placing multiple identical sensor assemblies 110 around the circumference, there is a greater chance that one of the sensor assemblies 110 will radially align with signal receiver 112. Because transmitter 160 must pass signals through solid portions of inner wellhead housing 124, casing hanger 130, and, in some embodiments, sensor assemblies 108, it can be helpful to minimize the distance that the data signal must pass. Indeed, when sensor assembly 110 is axially and radially aligned with signal receiver 112, the data signals are normal to sidewalls 126 and 132, thus giving the data signal the shortest path possible through the sidewalls. A cable (not shown) can be used to connect various sensor assemblies 110 to one another. The cable can be used to transfer data, such as from sensor elements 156 among the sensor assemblies 110. Cable 166 can also be used to transfer power from power supply 158 of one sensor assembly 110 to another sensor assembly 110.

Referring back to FIG. 3, data acquisition, transmission, and power management can be controlled by controller 162. In one embodiment, controller 162 can store acquired data in its memory until the data can be transmitted to an appropriate receiver such as, for example, signal receiver 112. Controller 162 can direct sensor assemblies 108, 110 to collect data regarding characteristics within annulus 134, 144 on a periodic basis or in response to an exception. An exception is an event that occurs or a sensor reading that is outside of a predetermined range or limit. An exception could be, for example, the presence of a particular type of fluid or a pressure or temperature that exceeds a threshold value.

Signal receiver 112 can be positioned within the transmission range of one or more of the sensor assemblies 110 and can send or receive data signals, such as radio frequency signals. Signal receiver 112 can be housed in a signal receiver body 172 having a generally cylindrical shape. Alternatively, the body can have other shapes including, for example, square, or octagonal. In one embodiment, signal receiver 112 can be an annular. Head 174 can be a portion of signal receiver 112 having an outer dimension that is greater than an outer dimension of body 172. The exterior of signal receiver body 172 can have a generally smooth surface or a threaded surface (not shown). In embodiments having a smooth surface along all or a portion of body 172, signal receiver 112 can be pressed into aperture 120. In embodiments having threads on an outer diameter of body 172, signal receiver 112 can threadingly engage corresponding threads on the inner diameter of aperture 120. Signal receiver 112 can form a fluid tight seal at aperture 120 to prevent fluids such as wellbore fluids from passing out of wellhead housing 100 and to prevent fluids such as seawater from passing into wellhead housing 100. A sealant (not shown) can be used to improve the seal between signal receiver 112 and aperture 120.

The exterior of signal receiver 112, including body 172 and head 174, can be made of any of a variety of materials including, for example, steel, or a corrosion resistant alloy ("CRA") such as an Inconel or cobalt based alloy. In one embodiment, body 172 is not damaged by cement or corrosive fluids that may be present in annulus 128. Signal receiver 112 can be installed in or on wellhead housing 100 before or after placing wellhead housing 100 on wellbore 102. In one embodiment, ROV 118 can install signal receiver 112 by inserting it into aperture 120 after wellhead housing is placed on wellbore 102. Such installation can be performed before or after landing inner wellhead housing 124 or casing hanger 130 in wellhead housing 100.

Signal receiver 112 can include a receiver 176 to receive signals 168 transmitted by transmitter 160 of sensor assemblies 110. Signal receiver 112 can be connected to a data collection unit such as computer 114 (FIG. 1) by, for example, cables 177, a wireless connection, or a combination thereof. In one embodiment, signal receiver 112 can transfer data to ROV 118, which can be connected via an umbilical 119 to platform 106. Signal receiver 112 can transmit data representing the signals it has received to computer 114, either directly or indirectly. In one embodiment, signal receiver 112 can also include a transmitter (not shown) for sending instructions to sensor assemblies 110. Signal receiver 112 can thus, for example, change the exception conditions or data acquisition and transmission frequency of sensor assemblies 110.

Signal receiver 112 can include a charging station 178 to charge power supply 158. As one of skill in the art will appreciate, charging station 178 can include a coil that can create an electromagnetic field 180. Because power supply 158 can also have a coil, it can, thus, be inductively charged by signal receiver 112.

Figure 4:
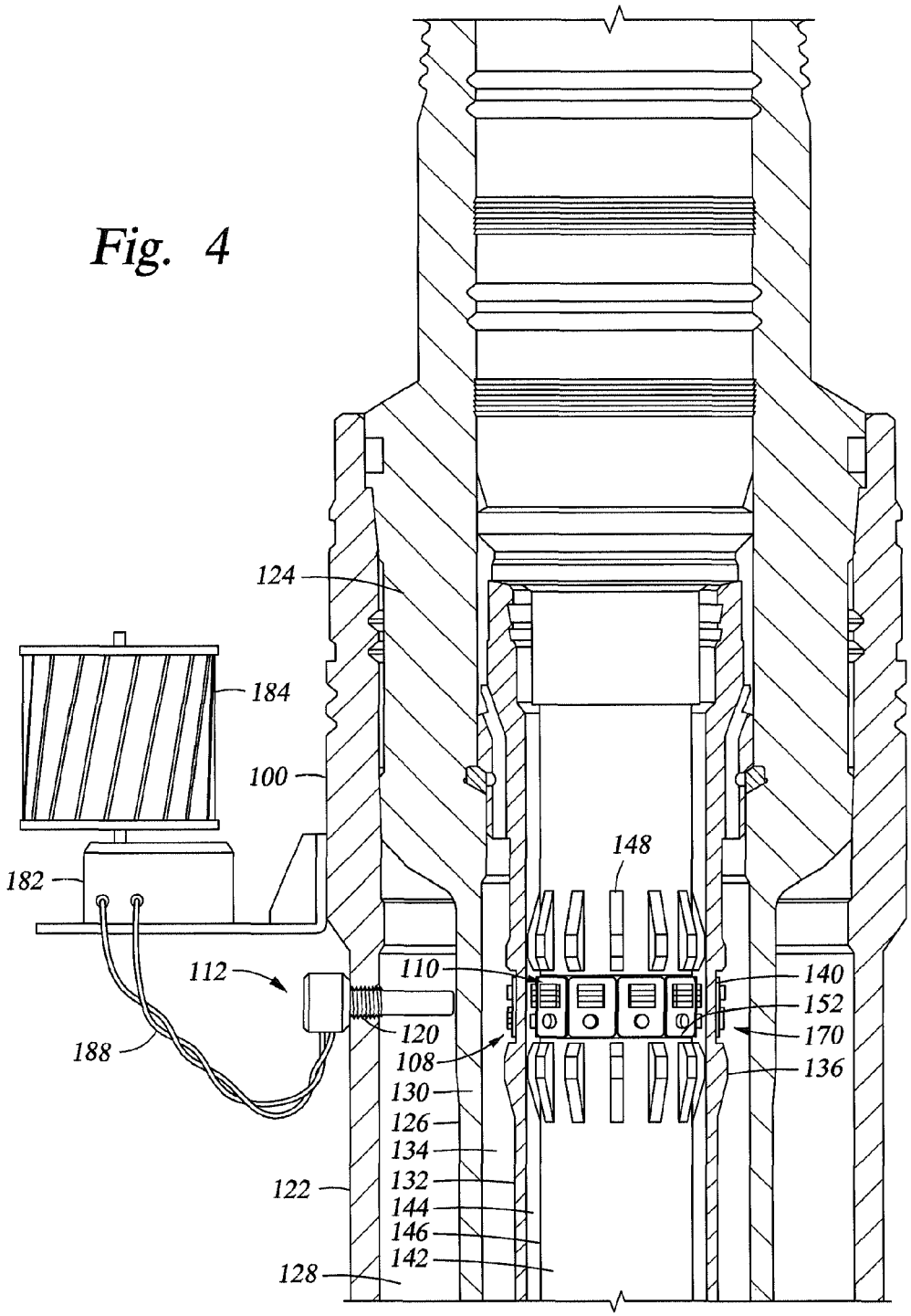
FIG. 4 is a partial sectional view of an embodiment of the wellbore annulus monitoring system of FIG. 1 with a subsea power supply.

Signal receiver 112 can be powered by one or more of a variety of power sources. For example, power can be provided by cable 181 (FIG. 2) from drilling platform 106. In one embodiment, cable 181 can also send and receive data from signal receiver 112 to computer 114. In one embodiment, signal receiver 112 can be powered by ROV 118. In another embodiment, as shown in FIG. 4, signal receiver 112 can be powered by a subsea power supply, such as current generator 182, that generates electricity in response to movement of seawater. Current generator 182 can be in contact with seawater outside of wellhead housing 100. Current generator 182 can have a turbine 184 that rotates in response to movement of seawater, either directly or indirectly, to turn generator module 186 and, thus, generate electricity. Power wires 188 can transfer electricity between current generator 182 and signal receiver 112. Signal receiver 112 can include a power storage device, such as one or more batteries, to store power. The power storage unit can be used to power signal receiver 112 during the times that it is not receiving power from an intermittent power supply such as ROV 118 or current generator 182.

In operation of an exemplary embodiment, conditions within a wellbore can be monitored by a wellbore monitoring system. The wellbore monitoring system can be part of wellhead housings 100, 124, which can be connected to wellbore 102. In the wellbore monitoring system, an inner wellbore member, such as inner wellhead housing 124, is positioned concentrically within wellhead housing 100. Annulus 128 can be located between wellhead housing 100 and inner wellhead housing 124. Signal receiver 112 can be inserted through a hole in outer wellhead housing 100 so that at least a portion of the signal receiver 112 is located within annulus 128. Signal receiver 112, or a portion of signal receiver 112, can be inserted through aperture 120 in the sidewall wellhead housing 100. This can be done before or after landing inner wellhead housing 124 in wellhead housing 100. Furthermore, it can be done before or after positioning wellhead housing 100 on wellbore 102. An ROV 118, for example, can insert signal receiver 112 into aperture 120.

A second wellbore member, such as casing hanger 130, can be positioned within inner wellhead housing 124, with an annulus between the two wellbore members. A sensor assembly 108 can be located in the annulus 134. The sensor assembly can be placed on an outer diameter of casing hanger 130 before casing hanger 130 is lowered into inner wellhead housing 124. A third wellbore member, such as tubing hanger 142 can then be lowered into casing hanger 130, again defining annulus 144 therebetween. A sensor assembly 110 can be located on an outer diameter of tubing hanger 142 so that it is positioned in annulus 144 after landing tubing hanger 142. After signal receiver 112 is installed and casing hanger 130 is in place, the wellhead housing cementing process can occur. The cement can flow through annulus 128 and around sensor assembly 112, which can withstand the flow of cement around its housing 172. There is an absence of apertures or other openings in the sidewalls 132, 146 in the vicinity of sensor assemblies 108, 110. Because there is an absence of apertures, there is less likelihood that fluid could leak out of either annulus 134, 144.

Either or both sensor assemblies 108, 110 can sense annulus conditions within annulus 134 and 144, respectively using sensor element 156. The conditions can include, for example, pressure, temperature, the presence of fluids, the identification of fluids, and pH. Data representing those annulus conditions can be stored in a memory unit within sensor assemblies 108,110, such as a memory unit located within controller 162. The data representing the annulus conditions can be transmitted through solid portions of sidewalls 132 or 146 to signal receiver 112. The sensor assemblies can be programmable to specify, for example, the frequency at which sensor assemblies 110 detect annulus conditions. For example, sensor assemblies 110 could be set to take a reading at 1 Hz or 10 Hz.

In one embodiment, a plurality of sensor assemblies 108 can be located in annulus 134. Similarly, a plurality of sensor assemblies 110 can be located in annulus 144. The pluralities of sensor assemblies 108, 110 can be arranged as a sensor ring. In one embodiment, each of the sensor assemblies 108, 110 can communicate with each other, either by wired or wireless communication, to transfer data to the other sensor assemblies 108, 110. For example, each of the sensor assemblies 108, 110 can transfer data to the sensor assembly 108, 110 that is located nearest to signal receiver 112, and then that sensor assembly 108, 110 can transmit data from all of the sensor assemblies 108, 110 to the signal receiver 112. In this embodiment, the transmission distance through sidewalls 132, 146 can be minimized.

The charging station 178 can send electromagnetic field 180 through casing hangers 124, 130 to power supply 158 of sensor assemblies 108, 110. The data signals 168 and electromagnetic field 180 are of frequency and power levels needed to overcome the potential gap between the signal and power inductor signal receiver 112 and the sensor assemblies 110.

After receiving data from sensor assemblies 108, 110, the signal receiver 112 can directly or indirectly transmit data representing the annulus conditions to another machine for live or archived monitoring, including further processing or analysis. For example, signal receiver 112 can transmit data to computer 114. The data can be transmitted by any of a variety of techniques including, for example, by cable 181, by wireless transmission, or by relay through other data communication devices located, for example, on riser 104 or on ROV 118. In one embodiment, data can be stored by sensor assemblies 108, 110, or by signal receiver 112 until such time as it can be relayed. For example, data can be stored until ROV 118 is in a position to receive the data. After receiving the data, computer 114 can display the data or generate alarms for exception conditions. The exception conditions can be, for example, a pressure that is greater than a predetermined level.

While the invention has been shown or described in only some of its forms, it should be apparent to those skilled in the art that it is not so limited, but is susceptible to various changes without departing from the scope of the invention.

What is claimed is:

1. A wellbore assembly, the wellbore assembly comprising:

an outer wellhead housing having a sidewall and an aperture extending through the sidewall;

an inner wellhead housing concentrically located within the outer wellhead housing to define a first annulus therebetween;

a first wellbore member concentrically located within the inner wellhead housing to define a second annulus therebetween;

a signal receiver secured in the aperture such that at least a portion of the signal receiver is located in the first annulus; and an outer sensor assembly located in the second annulus and axially aligned with the signal receiver, the outer sensor assembly being capable of sensing a second annulus condition and transmitting data representing the second annulus condition through a sidewall of the inner wellhead housing to the signal receiver.

2. The wellbore assembly according to claim 1, further comprising:

a second wellbore member, the second wellbore member being concentrically located within the first wellbore member to define a third annulus therebetween; and an inner sensor assembly located in the third annulus and being capable of sensing a third annulus condition and transmitting data representing the third annulus condition through a sidewall of the first wellbore member to the signal receiver.

3. The wellbore assembly according to claim 1, wherein the outer sensor assembly is located on an outer diameter of a sidewall of the first wellbore member, and further comprising upper and lower centralizers above and below the sensor assembly and protruding from the outer diameter of the sidewall of the first wellbore member, the centralizers protruding into the second annulus a greater distance than the outer sensor assembly.

4. The wellbore assembly according to claim 1, wherein the signal receiver comprises a corrosion resistant outer housing, the outer housing being able to withstand exposure to concrete.

5. The wellbore assembly according to claim 1, wherein the outer sensor assembly comprises a sensor, a transmitter, and a power supply.

6. The wellbore assembly according to claim 5, wherein the signal receiver includes an electromagnetic field generator, the power supply comprises a battery and a charger, and the charger inductively charges the battery in response to the electromagnetic field.

7. The wellbore assembly according to claim 1, wherein the outer sensor assembly includes a memory and stores the data representing the second annulus condition at least until the data representing the second annulus condition is transmitted to the signal receiver.

8. The wellbore assembly according to claim 1, wherein the signal receiver transmits the data to a computer.

9. The wellbore assembly according to claim 1, further comprising a current generator disposed subsea and operated by seawater outside of the housing member and connected to the signal receiver, the current generator producing electric current in response to movement of the seawater and transmitting the electric current to the signal receiver.

10. The wellbore assembly according to claim 9, wherein the current generator comprises a turbine, the turbine rotating in response to movement of the seawater to cause the current generator to produce the electric current.

11. The wellbore assembly according to claim 1, wherein the outer sensor assembly is one of a plurality of sensor assemblies spaced apart around the outer diameter of the first wellbore member, each sensor assembly having a transmitter, wherein the transmitter of the sensor assembly nearest the signal receiver can transmit data from one or more of the plurality of sensor assemblies.

12. The wellbore assembly according to claim 1, wherein the first annulus condition includes at least one of pressure and temperature.

13. A method for monitoring conditions within a wellbore assembly, the method comprising the steps of:

(a) connecting an outer wellhead housing to a wellbore, the outer wellhead housing having a sidewall and an aperture through the sidewall;

(b) positioning an inner wellhead housing concentrically within the outer wellhead housing to define a first annulus therebetween;

(c) positioning a first wellbore member concentrically within the inner wellhead housing to define a second annulus therebetween, with a sensor assembly located in the second annulus, the sensor assembly having a sensor element, a power supply, and a transmitter;

(d) positioning a signal receiver in the aperture; and (e) sensing a second annulus condition with the sensor assembly and transmitting data representing the second annulus condition through a sidewall of the inner wellhead housing to the signal receiver.

14. The method according to claim 13, further comprising the step of generating an electromagnetic field by the signal receiver to inductively charge the power supply.

15. The method according to claim 14, wherein a current generator disposed subsea generates electric current in response to movement of seawater and the electric current is used to power the signal receiver.

16. The method according to claim 13, further comprising the step of sending data representing the second annulus condition from the signal receiver to a computer.

17. The method according to claim 13, wherein the sensor assembly is one of a plurality of sensor assemblies, wherein step (e) further comprises the step of transmitting data from the one of the plurality of sensor assemblies nearest the signal receiver to the signal receiver.

18. The method according to claim 17, wherein at least one of the plurality of sensor assemblies transmits data representing a second annulus condition to at least another one of the plurality of sensor assemblies.

19. A wellbore assembly, the wellbore assembly comprising:

an outer wellhead housing having a sidewall and an aperture through the sidewall;

an inner wellhead housing concentrically located within the outer wellhead housing to define a first annulus therebetween;

a first wellbore member concentrically located within the inner wellhead housing to define a second annulus therebetween;

a signal receiver secured in the aperture such that at least a portion of the signal receiver is located in the first annulus;

an outer sensor assembly positioned in the second annulus and axially aligned with the signal receiver, the outer sensor assembly comprising a sensor, a transmitter, and a power supply, and being capable of sensing a second annulus condition and transmitting data representing the second annulus condition through a sidewall of the inner wellhead housing to the signal receiver; and a second wellbore member, the second wellbore member being concentrically located within the first wellbore member to define a third annulus therebetween, and an inner sensor assembly positioned in the third annulus and being capable of sensing a third annulus condition and transmitting data representing the third annulus condition through a sidewall of the first wellbore member to the signal receiver.

20. The wellbore assembly according to claim 19, wherein the signal receiver can generate an electromagnetic field and wherein the power supply comprises a battery and a charger and the charger inductively charges the battery in response to the electromagnetic field.

* * * * *